US006442966B1

(12) United States Patent
Wiser

(10) Patent No.: US 6,442,966 B1
(45) Date of Patent: Sep. 3, 2002

(54) FIXED ORIFICE EXPANSION DEVICE

(75) Inventor: Herman David Wiser, Buda, TX (US)

(73) Assignee: Chatleff Controls, Inc., Buda, TX (US)

( * ) Notice: Subject to any disclaimer, the term of this patent is extended or adjusted under 35 U.S.C. 154(b) by 0 days.

(21) Appl. No.: 09/781,008

(22) Filed: Feb. 9, 2001

(51) Int. Cl.[7] ..... F25B 41/06
(52) U.S. Cl. ..... 62/511
(58) Field of Search ..... 62/511; 138/44

(56) References Cited

U.S. PATENT DOCUMENTS

| | | | | | |
|---|---|---|---|---|---|
| 2,401,665 | A | | 6/1946 | Schick | 138/40 |
| 2,672,159 | A | | 3/1954 | Walton | 138/41 |
| 2,676,470 | A | | 4/1954 | Streitz | 62/127 |
| 2,804,928 | A | | 9/1957 | Farrar | 166/224 |
| 2,829,673 | A | | 4/1958 | Reese | 138/44 |
| 4,009,592 | A | * | 3/1977 | Boerger | 62/222 |
| 4,263,787 | A | * | 4/1981 | Domingorena | 62/511 |
| 4,412,432 | A | * | 11/1983 | Brendel | 62/511 |
| 4,429,552 | A | * | 2/1984 | Reedy | 62/511 |
| 4,644,974 | A | | 2/1987 | Zingg | 138/44 |
| 4,653,291 | A | | 3/1987 | Moeller et al. | 62/511 |
| 4,971,117 | A | * | 11/1990 | Hendrickson | 138/44 |
| 5,135,023 | A | * | 8/1992 | Ross | 137/505.11 |
| 5,186,021 | A | * | 2/1993 | Keller | 62/511 |
| 5,507,468 | A | * | 4/1996 | Evans | 62/511 |

* cited by examiner

*Primary Examiner*—William E. Tapolcai
*Assistant Examiner*—Mohammad M Ali
(74) *Attorney, Agent, or Firm*—Trop, Pruner & Hu, P.C.

(57) ABSTRACT

Disclosed is a fixed orifice expansion device for use in connection with couplings, such as refrigerant couplings. The novel device includes a body having first and second ends, and an orifice therethrough. At least one end of the body includes a sealing mechanism for sealing the device within a bore of a cooperative coupling or the like, while the opposing end includes means for installing the body within the cooperative coupling. By use of the disclosed expansion device, a service valve for refrigerant expansion may be accomplished with three standard ARI fittings.

18 Claims, 7 Drawing Sheets

FIXED ORIFICE EXPANSION DEVICE

BACKGROUND OF THE INVENTION

1. Field of the Invention

The present invention relates generally to expansion devices and, more specifically, to expansion devices having a fixed orifice.

2. Description of Related Art

Certain refrigerant units, specifically, smaller units and multiple evaporator units (commonly referred to as "multi-vaps") typically use smaller orifices than larger units. Many of the available fixed orifice devices available are as large as the service valves themselves on these units. Most of them require a custom enclosure of some sort, some of them are pressed in, and others are brazed in.

SUMMARY OF THE INVENTION

The present invention includes a device designed to work with a standard ARI (American Refrigeration Institute) ¼" flare fitting, already present on most service valves. In use, a service valve manufacturer may add another flare fitting in place of the outlet port on the service valve to avail himself of the advantages of a device according to the present invention. This device permits balancing the system by simply removing one orifice size and substituting another with a simple valve core removal tool as opposed to torch welding or pressing another orifice device into the system. In addition, as many as four orifices in one service valve package may be used to feed four evaporators connected to one condensing unit, without adding any additional bulk to the package other than the four ¼" flare ports required to hold the orifices.

In one example, multi-vaps commonly use manifolds connected to tubes containing fixed orifices, one per circuit. Using one service valve with 2, 3, or 4 devices according to the present invention eliminates the manifold and 2, 3, or 4 tube/orifice combinations from the mass and volume of the total unit. If different size evaporators are used, such devices may be easily changed out to balance the system, whereas manifold-tube combination would require unbrazing the assembly to change the orifice size. Thus, a device according to the present invention represents an economical substitute, especially in custom installations.

In one embodiment, the present invention includes a refrigerant coupling having a body with first and second ends, an orifice extending therethrough for flow of a desired fluid, in which the first end has an externally threaded portion, and the second end has a sealing member. Further, the coupling includes a refrigeration port having first and second ends and a bore extending therethrough, in which one end has an internally threaded portion, and the other end has a connecting member. The port is sized to receive the body; and when the externally threaded portion of the body is engaged within the bore, the sealing member is in sealing relation to the bore.

In another embodiment, the present invention includes a fixed orifice expansion device with a body having first and second ends, means for torquing the body into a desired location of a cooperative port, and a sealing member. Further, the body has an orifice extending therethrough for conduction of a desired fluid, and an externally threaded portion between the ends for engaging the body within the cooperative port. In assembly, the sealing member seals the body to the cooperative port, thereby permitting flow of fluid throughout the orifice and into the cooperative port.

In yet another embodiment, a fixed orifice expansion device includes a body having top and bottom ends, with a bore extending therethrough. Further, the top end has a means to actuate the body into a desired position within a receptacle socket, and the bottom end has a sealing mechanism to fix the body with respect to the receptacle socket.

It is an object of the present invention to provide a fixed orifice device for small capacity (i.e., to about 0.75 to 3.0 tons) refrigerant expansion that may be easily changed. In exemplary embodiments, the device may screw into a standard ¼" valve core compatible ARI flare fitting.

By use of the present invention, a service valve for refrigerant expansion may be made with three standard ARI fittings. Further, any one of the fittings may be used as the expansion port, leaving the remaining ports to act as an inlet (or outlet) and a charging port. By doing so, the number of versions of a basic service valve needed to cover all possible port orientations is reduced.

It is a further object of the present invention to provide an easily changed fixed orifice device for cooling-only systems (as opposed to heat pumps) without the extra expense of requiring a precision check valve/orifice combination.

It is a further object of the present invention to provide an orifice device that screws into a standard ARI fitting (such as a standard ¼' refrigeration fitting) and which advantageously utilizes the taper surface and threads typically used by a valve core. Such an advantage over the prior art permits the device according to the present invention to be universally applicable without a specialized enclosure.

The device according to the present invention may be used in combination with various connectors typically used in the refrigeration industry, such as, for example, flare fittings, such as ¼" and ⅜" flare parts and the like.

In operation, the device according to the present invention may be positioned in a receptacle socket of any desired connector. In exemplary embodiments, the device may be screwed into the receptacle socket of the connector, and be sealed into desired position by butting up against a taper in the bottom of the socket. In various embodiments, the seal may be accomplished by an O-ring located about the device, or by a spherical surface machined on the external bottom end of the device. Alternatively, the seal may be molded in place (such as a valve core, as is common in tire and charging port applications) or heat shrunk onto a groove of the device.

In exemplary embodiments, the taper and socket are made to the same dimensions as used for a depression type valve core, which is used in charging ports of almost all air conditioning service valves (and also automotive tires).

As used herein, a "threaded" portion has one or more threads. Additionally, "thread" means any spiral or helical configuration that may be provided on any device for the purpose of facilitating the engagement of parts as discussed below in greater detail. It is understood that such configurations include, but are not limited to, any conventional threads known in the art such as American National pipe threads, Unified threads, SI threads, Acme stub threads, Whitworth threads, any non-conventional (i.e., proprietary) threads, or any multi-pitch threads. As used herein, one "thread" means the extent of the configuration which may be engaged in a single revolution of the device on which the thread is provided, while "threads" means the extent of the configuration which may be engaged by more than a single revolution of the same, but not necessarily two full revolutions.

As used herein, "fluid fitting" means any conventional fluid fitting known in the art, such as a flare, ferrule, rotary (including sweat and weld), or braze fitting, etc., any conventional thread known in the art, such as those mentioned above, any non-conventional thread, or any non-conventional fluid fitting.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

It is to be noted, however, that the appended drawings illustrate only exemplary embodiments of the invention and are therefore not to be considered limiting of its scope, for the invention may admit to other equally effective embodiments.

DETAILED DESCRIPTION

Figure 1:
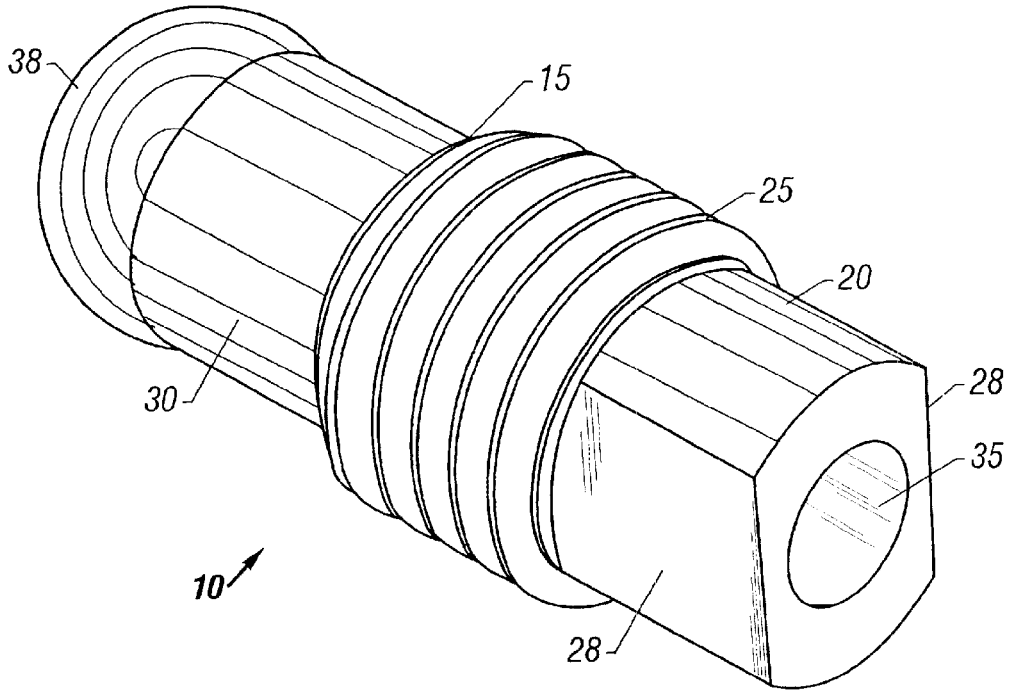
FIG. 1 is a perspective view of a fixed orifice expansion device according to the present invention.

FIG. 1 shows an exemplary embodiment of a fixed orifice expansion device 10 according to the present invention. As shown in FIG. 1, the device 10 comprises a body 15 having a first end 20 and a second end 30. An orifice 35 extends throughout the body 15 and permits a flow of fluid through the device. In exemplary embodiments, the fluid may be air, water, coolant, and the like. As shown in FIG. 1, first end 20 includes threads 25, which are used to engage opposing threads of a fitting to which the device is to be engaged. Above the threads 25 of the first end 20, there is a means for torquing 28, which is used to torque the device into the desired location. However, in other embodiments, it is possible for the threads to extend to the top of the first end of the device.

As shown in FIG. 1, the top of the first end 20 of the body 10 includes a means for torquing 28 which, as shown in FIG. 1, are machined flats so that the device may be torqued with an appropriate wrench into its desired position. In exemplary embodiments, a typical valve core wrench may be used to insert the device. In exemplary embodiments, the flats may be machined to approximately a 0.075 inch span. However, in other embodiments the flats may be dimensioned between about 0.060 and 0.090 inch. It is to be understood that other means for torquing the device into position may be used, such as a square platform, hex-shaped platform, or the like. The means is preferably constructed such that a wrench or pliers may be used to accomplish insertion. In exemplary embodiment, a valve core wrench may be used to insert the device. The means for torquing may have a span that ranges from approximately 0.05" to 0.20", and more typically, a ⅜" device may have a pair of flats having a 0.075" span, and a ½" device may have a ⅛" span between flats.

Second end 30 includes a sealing member 38, which as shown in FIG. 1 is a spherical surface protruding from and extending around second end 30. In alternate embodiments, this sealing member 38 may be a tapered surface, an O-ring, molded plastic, polymer, or the like. The sealing member 38 is used to seal the body 15 to a cooperative device, which in an exemplary embodiment may be a connector, flare fitting, or the like. Details of the engagement of the device 10 to a cooperative device are discussed below with respect to FIGS. 6–8.

Figure 9:
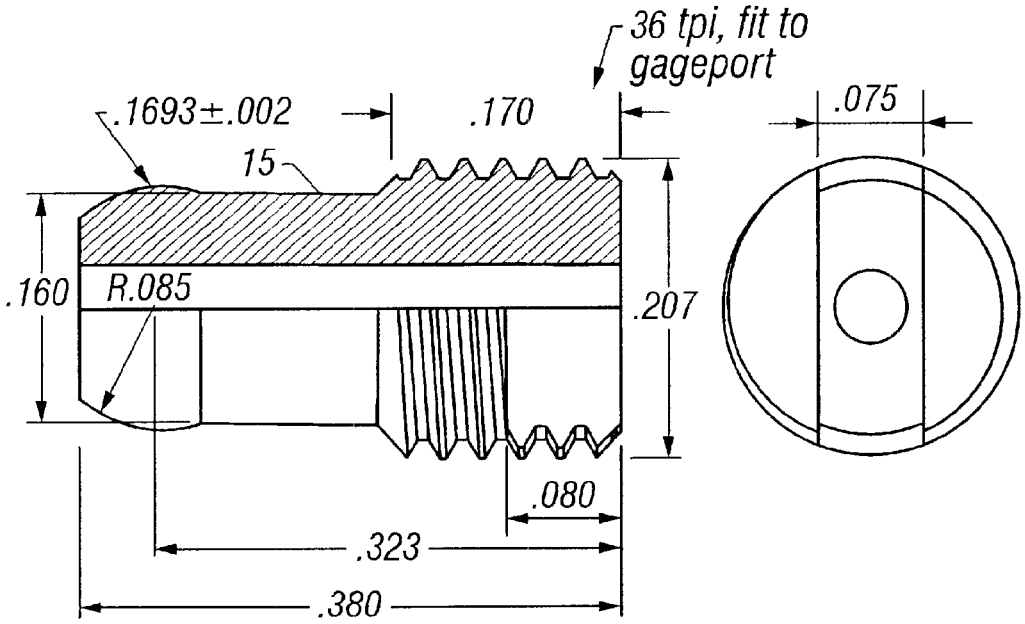
FIG. 9 is a cross sectional view of the embodiment of a fixed orifice expansion device according to the present invention shown in FIG. 1 and indicates specifications of an exemplary dimensioned device.

Embodiments of the device shown in FIG. 1 may have various dimensions. However, for a ⅜" long device, FIG. 9 shows specifications of an exemplary device. It is to be understood that dimensions of other devices according to the present invention may be larger or smaller than those shown in FIG. 9, depending on the connector to which the device is to be adapted.

The device according to the present invention may be constructed in a variety of sizes to accommodate different size fittings. The length of the device for use in refrigerant systems may vary from approximately 0.25" to 0.75" and more typically be ⅜" or ½". Further, the bore or orifice diameter may also vary, and may range from approximately 0.025" to 0.90", and more typically be approximately 0.070" for a ⅜" length device and be approximately 0.090" for a ½" length device.

Figure 2:
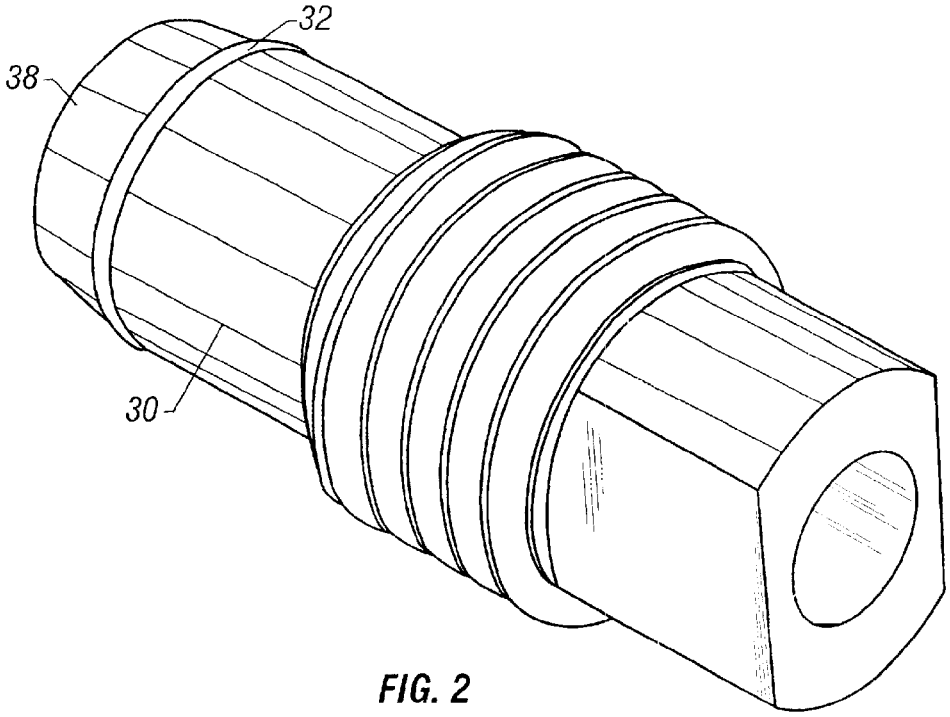
FIG. 2 is a perspective view of an alternate embodiment of a fixed orifice expansion device according to the present invention.

FIG. 2 shows an alternate embodiment of a fixed orifice expansion device according to the present invention. Note that like numerals indicate elements similar to the embodiment of FIG. 1. As shown in FIG. 2, sealing member 38 is designed as a tapered cylinder, as opposed to the spherical surface of the embodiment shown in FIG. 1. By use of such a tapered cylinder, a proper seal may be formed between the device and a cooperative fitting.

Further, second end 30 of FIG. 2 includes an O-ring 32 which is used to aid in sealing the device within the fitting to which it is engaged. The material from which O-ring 32 may be formed depends on the fluid with which O-ring 32 will come into contact. For example, if the device is used in a refrigerant system in which fluids such as oil or Freon 22 are utilized, a neoprene compound may be used which is sold under the name PARCO 3110-70 from Parco (1250 Parco Ave., Ontario, Calif. 91761) or the name PARKER 0873-70 from Parker, Hannifin Seal Group (18321 Jamboree Rd., Irvine, Calif. 92715-1011). Alternatively, various materials such as TEFLON, RULON, and NYLON maybe used.

Figure 10:
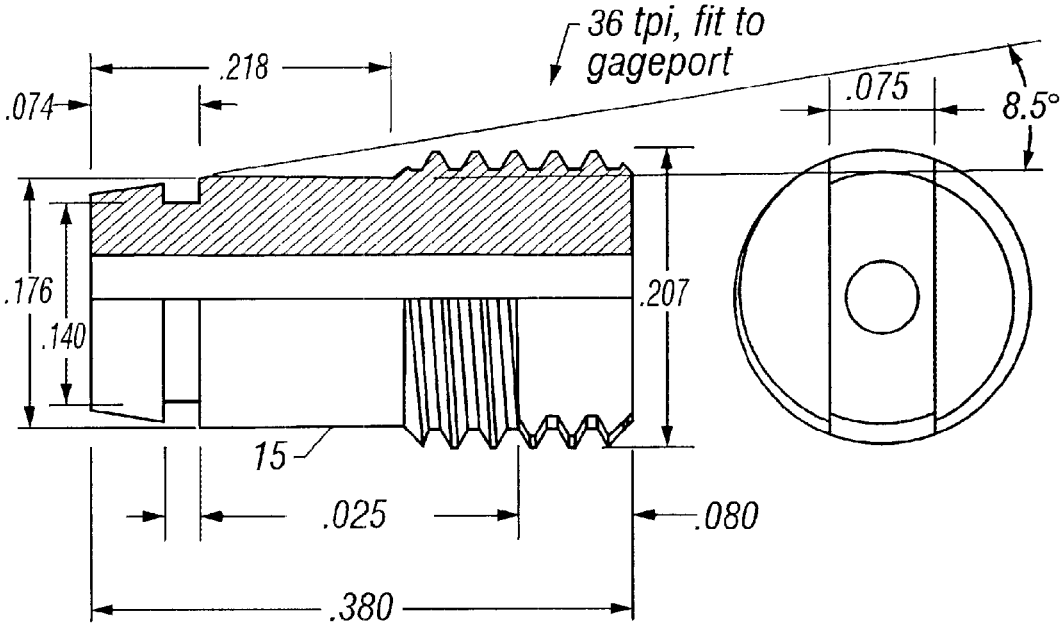
FIG. 10 is a cross sectional view of the embodiment of a fixed orifice expansion device according to the present invention shown in FIG. 2 and indicates specifications of an exemplary dimensioned device.

Embodiments of the device shown in FIG. 2 may have various dimensions. However, for a ⅜" long device, FIG. 10 shows specifications of an exemplary device. It is to be understood that dimensions of other devices according to the present invention may be larger or smaller than those shown in FIG. 10, depending on the connector to which the device is to be adapted.

Figure 3A:
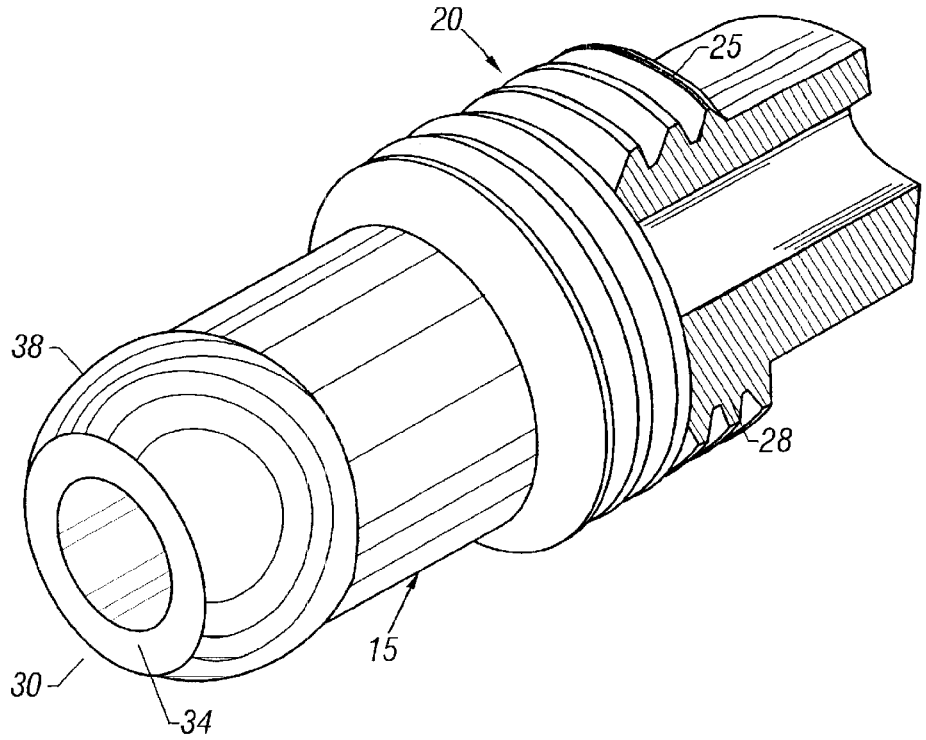
FIG. 3A is a partial perspective view of the fixed orifice expansion device shown in FIG. 1.
Figure 3B:
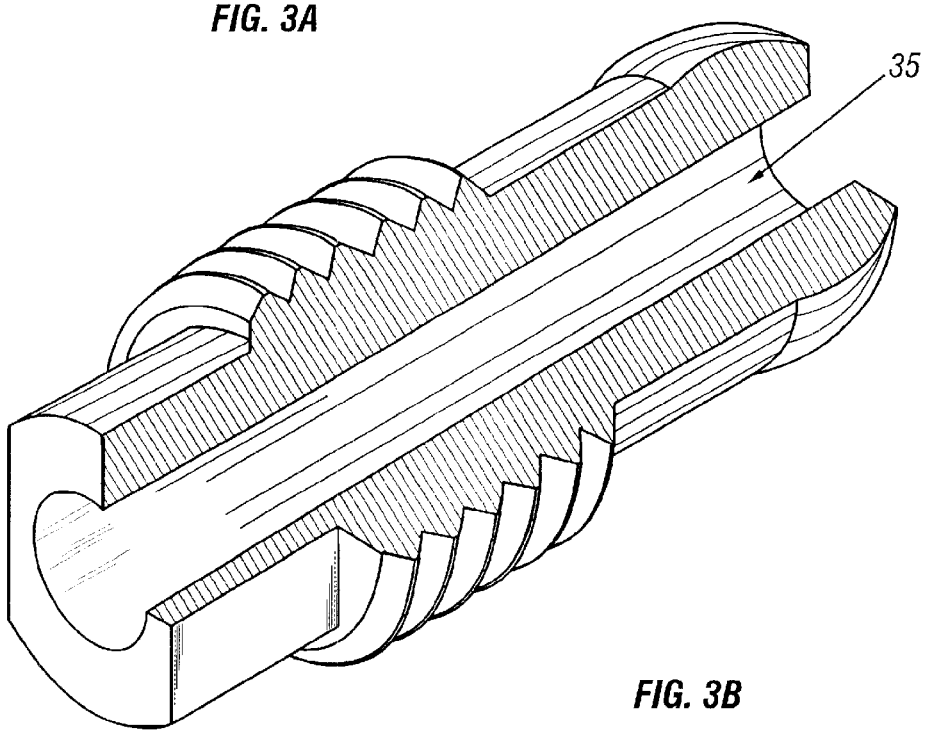
FIG. 3B is a partial cutaway view of the fixed orifice expansion device shown in FIG. 1.

FIG. 3A is another view of the embodiment shown in FIG. 1, which shows more clearly the bottom of the second end 30. As seen in FIG. 3A, the bottom of second end 30 comprises an annular surface 34. FIG. 3B shows a partial cutaway view of the device of FIG. 1. As shown in FIG. 3B, the bore 35 is generally cylindrical. However, in other embodiments, the bore 35 may be tapered or otherwise dimensioned.

Figure 4A:
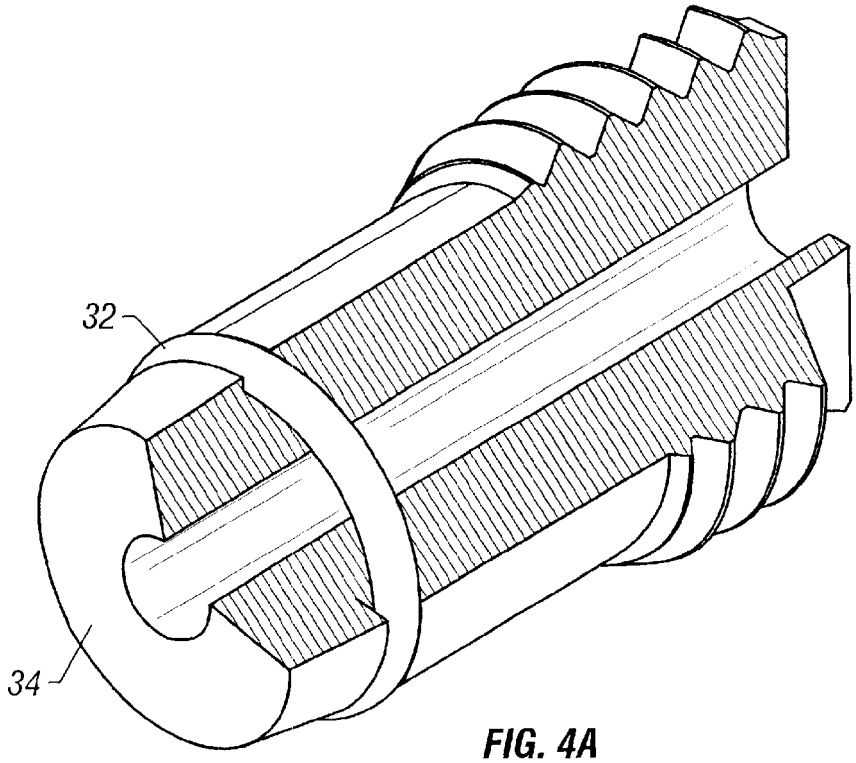
FIG. 4A is a partial perspective view of the fixed orifice expansion device shown in FIG. 2.
Figure 4B:
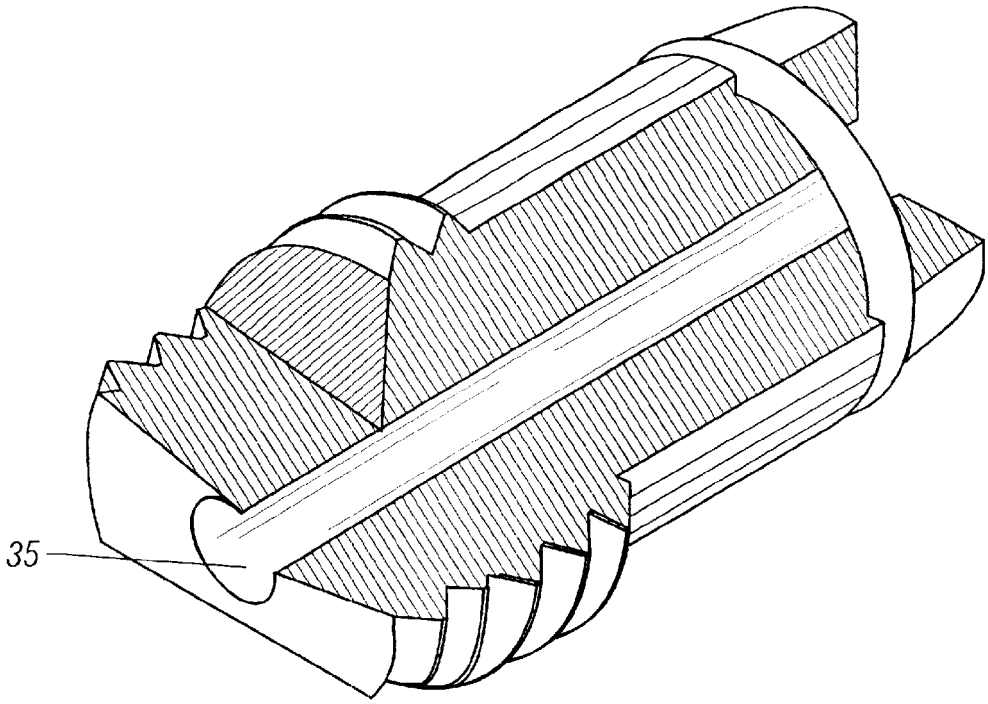
FIG. 4B is a partial cutaway view of the fixed orifice expansion device shown in FIG. 2.

FIG. 4A is another view of the embodiment shown in FIG. 2, which shows more clearly the bottom of the second end 30. As seen in FIG. 4A, the bottom of second end 30 comprises an annular surface 34. FIG. 4B shows a partial cutaway view of the device of FIG. 2. As shown in FIG. 4B, the bore 35 is generally cylindrical. However, in other embodiments, the bore 35 may be tapered or otherwise dimensioned.

Figure 5:
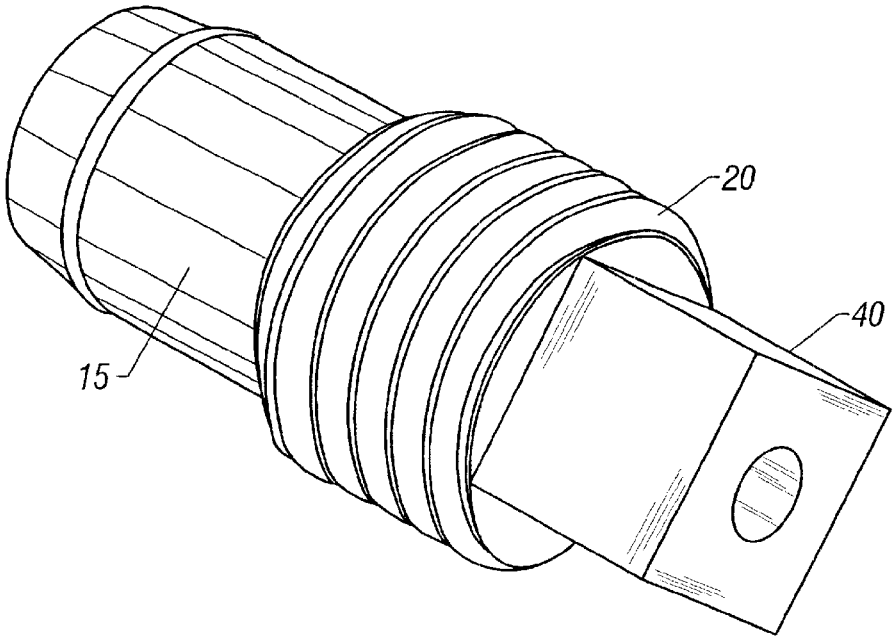
FIG. 5 is a perspective view of an embodiment of a fixed orifice expansion device according to the present invention illustrating an alternate means for torquing the device.

FIG. 5 is an embodiment of a fixed orifice expansion device according to the present invention in which there is a square platform 40 extending from first end 20 of the body 15. The square platform 40 acts as a means for torquing, and allows for higher torque capability than a pair of flats. Alternately, platform 40 may be shaped in other ways, such as a pentagon or hexagon, for example.

Figure 6:
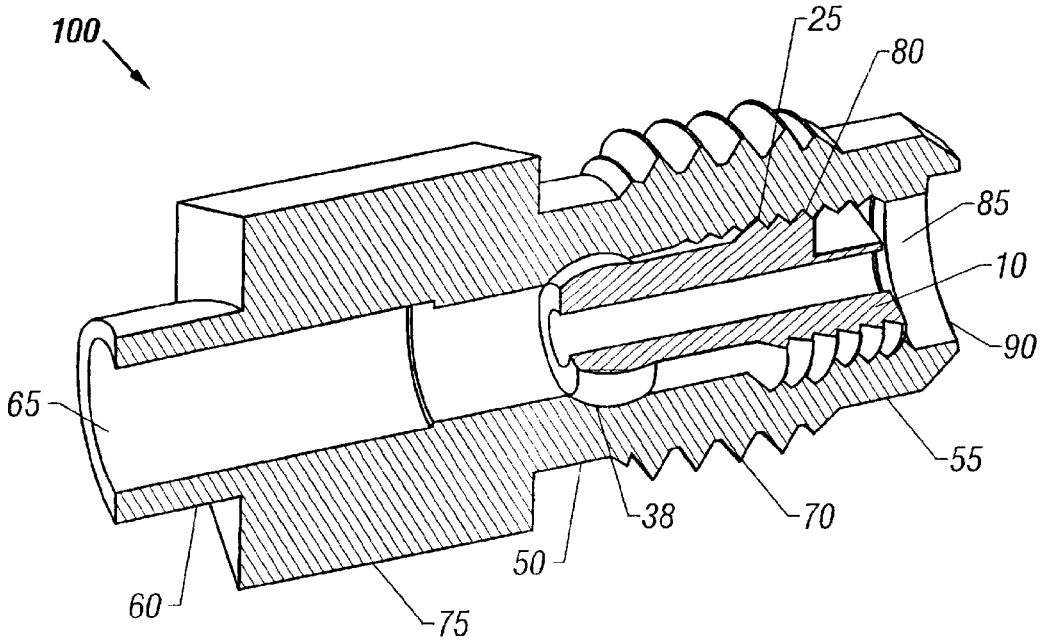
FIG. 6 is an exemplary embodiment of a fixed orifice expansion device according to the present invention engaged within a typical refrigerant fitting.

FIG. 6 shows a partial cutaway view of a system 100 according to the present invention. As shown in FIG. 6, the system 100 comprises a fixed orifice device 10 engaged within a connector 50 which, as shown in FIG. 6 is a flare fitting, which may be used as an ARI charging/connection port. Connector 50 has a first end 55 and a second end 60, and has a bore 65 extending throughout the connector 50. Interposed between the two ends of the connector 50 are a set of external threads 70, which may be used to adapt the connector 50 to another device, such as an ARI charging/connection port or the like. Further interposed between the ends is a noncylindrical exterior configuration 75 to facilitate connection to cooperatively adapted devices. The noncylindrical exterior configuration 75 (hex shaped, for example) is adapted to receive tools such as a ratchet, a wrench, a torque wrench, a powered driver (electric, pneumatic, or hydraulic), an electronic torquing device. It is to be understood that noncylindrical exterior configurations are optional, and need not be provided on the connectors of the present invention.

In embodiments of the present invention in which the connector is not provided with a noncylindrical exterior configuration, tools such as a collet-type device, a pipe wrench, etc., may be applied to the connector to facilitate its connection to cooperatively adapted connectors.

As shown in FIG. 6, the orifice device 10 is inserted into the connector 50, and the externally threaded portion 25 of the device 10 is engaged by the internally threaded portion 80 of the connector 50. Further, the sealing mechanism 38 of the device 10 achieves a sealing relation with the walls of the bore 65, which in the embodiment shown in FIG. 6, are tapered.

The top end 85 of the connector 50 is tapered, and terminates in an annular ring 90. Although the first end 20 of the device 10 is shown as being below the top end 85 of the connector 50, in other embodiments, the first end 20 may be axially coexistent with, or even above the top end 85 of the connector 50.

Figure 7:
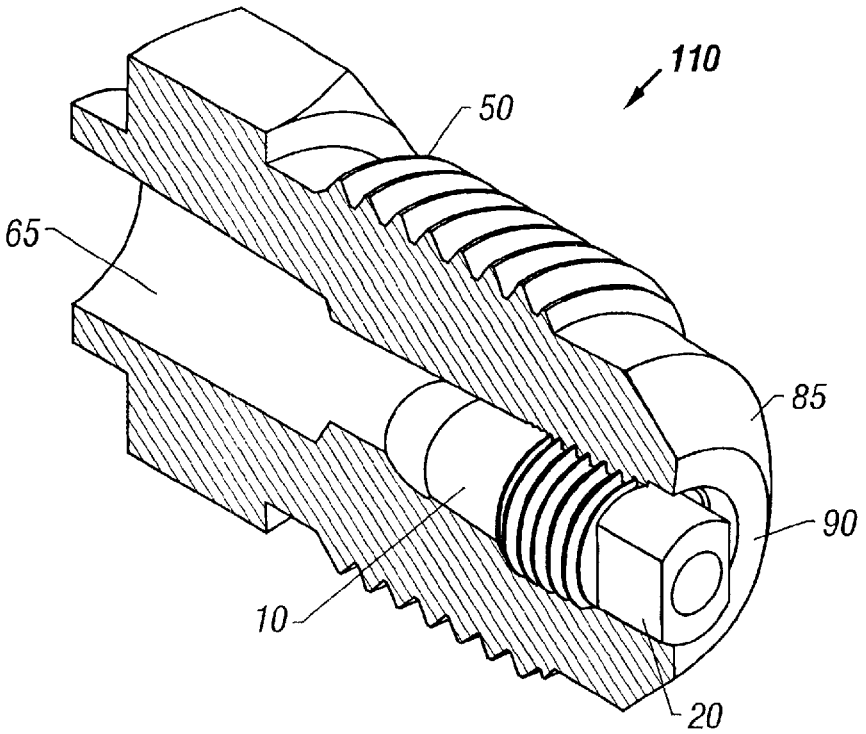
FIG. 7 is an exemplary embodiment of a fixed orifice expansion device according to the present invention engaged within an alternate typical refrigerant fitting.

FIG. 7 shows an alternate embodiment of a system 110 according to the present invention. In that system, the first end 20 of the device 10 extends beyond the top end 85 of the connector 50.

Figure 8:
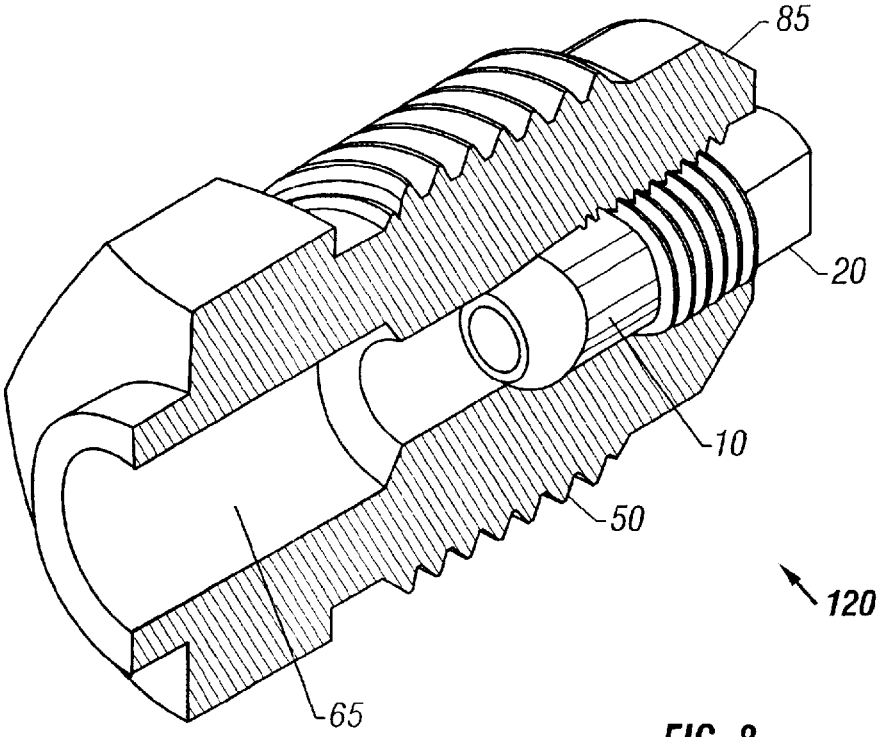
FIG. 8 is an alternate view of the embodiment in FIG. 7.

FIG. 8 shows yet another alternate embodiment of a system 120 according to the present invention, in which the first end 20 of the device 10 extends beyond the top end 85 of the connector 50. Note further that in each of the embodiments shown in FIGS. 6–8, the bore 65 of the connector is tapered to a different degree, and it is to be understood that varying levels of taper (or no taper whatsoever) are contemplated by the present invention.

Figure 11:
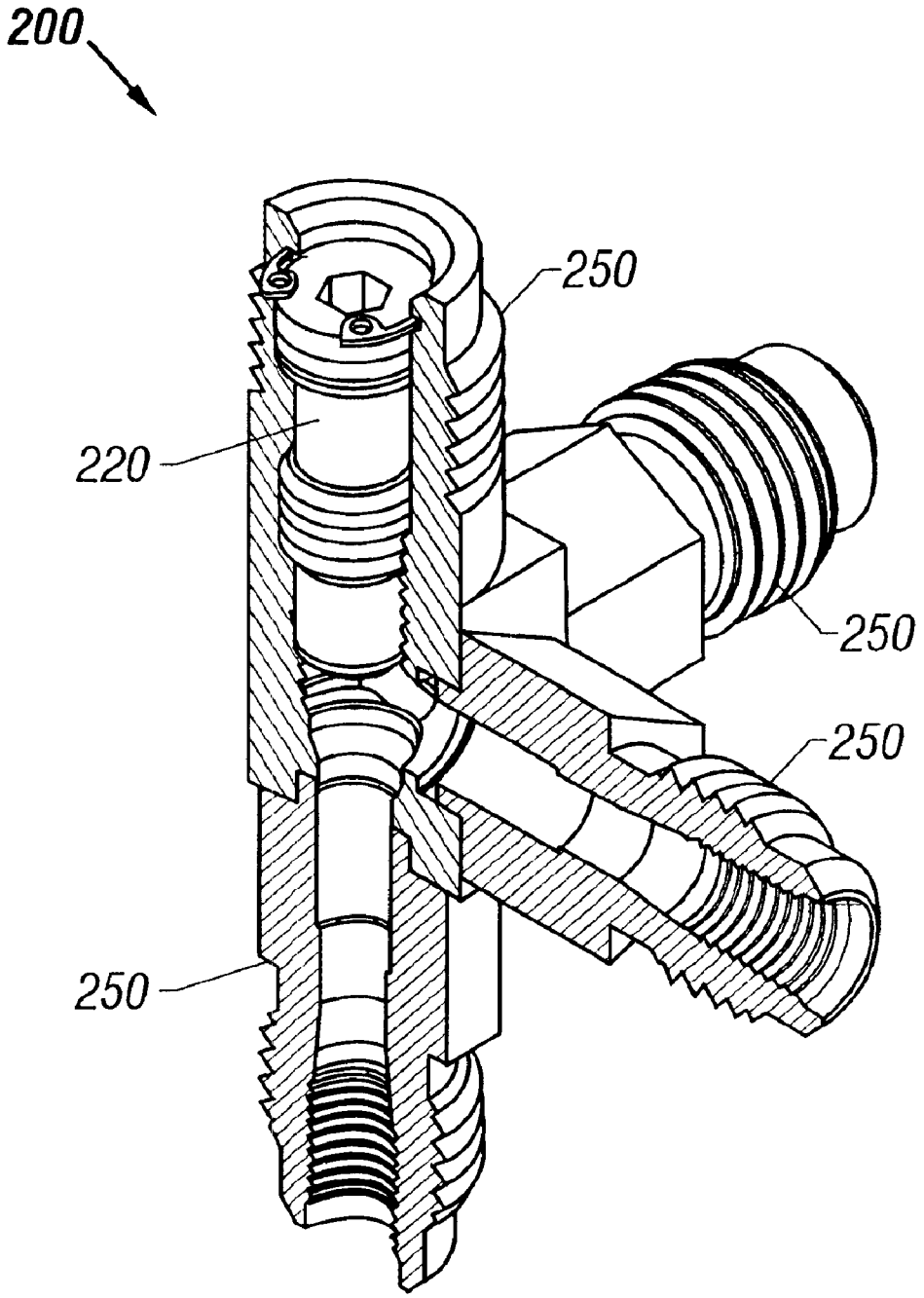
FIG. 11 is a partial cutaway view of a service valve for refrigerant expansion.

FIG. 11 shows a service valve 200. As shown in FIG. 11, the service valve 200 includes a plurality of adjoined connectors 250, each of which may be connected to a different line. Further, the service valve 200 includes a device 220, which is a valve stem of the service valve 200. When it is screwed down, it isolates the bottom port from the upper ports with a TEFLON seal. It is used for servicing the equipment (hence the term service valve). By placement of a device 10 according to the present invention in one or more of the connectors 250, any of the connectors 250 may act as the inlet, outlet, or charging port.

The benefit to a manufacturer is a cost savings in that the same port may be used for all three service valve connections. The benefit to the consumer is that one valve may be used for several physical arrangements by simply switching which port contains a valve core, and which one contains a device in accordance with the present invention.

With prior art devices, one has to manufacture a large number of alternate porting configurations specific to a given customer's need. On small units, the use of generic, switchable purpose ports reduces the number of manufacturing setups for a manufacturer, and inventory for the customer. The customer also gains an advantage in having the expansion device as a part of the service valve, instead of having to buy an independent device for this purpose.

The embodiments of a system that may be assembled from the device according to the present invention may be suitable for different pressure applications, such as those in which pressures of about 0 to about 600 psid may be encountered. As used herein, "psid" stands for pounds per square inch differential. Such applications may include, for example, refrigeration, some hydraulic systems, warmed water loops, chilled water loops, and heat pump primary loop exchangers. Flare fittings that may be provided on the connector 50 may be adapted to conform to the conventional standards for the particular device (such as a refrigeration pump primary loop exchanger) and/or pressure range with which the system may be used. For example, 45° flare fittings may be used in medium pressure refrigeration applications. As another example, brazed joints may be used instead of 45° flare fittings.

In accordance with the present invention, the device 10 and connector 50 may be constructed of any metal, alloy or other material suitable for pipe connectors, such as copper, brass, bronze, stainless steel, aluminum, zinc, leaded free machining steel, or the like, and manufactured from bar stock using a screw machine, for example.

The embodiments of the present invention described above are well suited to a variety of applications. For example, the present invention may be used in connection with air pressure systems, natural and manufactured gases, and combustible gases and fluids.

OTHER EMBODIMENTS

While the invention has been described with respect to the embodiments and variations set forth above, these embodiments and variations are illustrative and the invention is not to be considered limited in scope to these embodiments and variations. Accordingly, various other embodiments and modifications and improvements not described herein may be within the spirit and scope of the present invention, as defined by the following claims.

What is claimed is:

1. A refrigerant coupling, comprising:

a body having first and second ends, said body having an orifice extending therethrough for flow of a desired fluid, said first end having an externally threaded portion, said second end comprising a sealing member integrated with said body;

a refrigeration port having first and second ends, said refrigeration port having a bore extending therethrough, said first end having an internally threaded portion, and said second end having a connecting member, said refrigeration port being sized to receive said body; and said externally threaded portion of said first end of said body being engaged within said bore by said internally threaded portion of said first end of said refrigeration port to position said sealing member in sealing relation to at least a portion of said bore.

2. The refrigerant coupling of claim 1, wherein said sealing member comprises a spherical surface seal, said spherical surface seal sized to sealingly contact at least a portion of said bore.

3. The refrigerant coupling of claim 1, wherein said sealing member comprises an O-ring, said O-ring sized to sealingly contact at least a portion of said bore.

4. The refrigerant coupling of claim 1, wherein said first end of said body further comprises a means for torquing said body into said refrigeration port.

5. The refrigerant coupling of claim 4, wherein said means for torquing comprises a pair of flats.

6. The refrigerant coupling of claim 4, wherein said means for torquing comprises a square platform, a pentagonal platform, or a hexagonal platform.

7. The refrigerant coupling of claim 1, wherein said second end of said body comprises an annular surface.

8. The refrigerant coupling of claim 1, wherein said bore and said orifice are concentrically adapted.

9. The refrigerant coupling of claim 1, wherein said bore expands from said first end to said second end of said refrigeration port.

10. The refrigerant coupling of claim 4, wherein said means for torquing extends beyond said refrigeration port.

11. A fixed orifice expansion device, comprising:

a body having first and second ends, said first end comprising a means for torquing said body into a desired location of a cooperative port, said second end comprising a sealing member integral to said body;

said body having an orifice extending therethrough for conduction of a desired fluid;

said body having an externally threaded portion between said first and second ends, said externally threaded portion for engaging said body within said cooperative port; and wherein said sealing member seals said body to said cooperative port, thereby permitting flow of said desired fluid throughout said orifice and into said cooperative port.

12. A fixed orifice expansion device, comprising:

a body having a top end and a bottom end, said body having a bore extending therethrough;

said top end having a means to actuate said body into a desired position within a receptacle socket;

said receptacle socket having an orifice extending therethrough;

said bottom end having a sealing mechanism to fix said body within said orifice;

said body further having an externally threaded portion above said bottom end.

13. The fixed orifice expansion device of claim 12, where said bore is generally cylindrical.

14. The fixed orifice expansion device of claim 12, wherein said receptacle socket is located within a refrigerant coupling.

15. The fixed orifice expansion device of claim 12, wherein said means to actuate comprises a wrench adapter.

16. The fixed orifice expansion device of claim 12, wherein said sealing mechanism comprises an O-ring.

17. The fixed orifice expansion device of claim 12, wherein said orifice is tapered;

said orifice being of a flare fitting.

18. The fixed orifice expansion device of claim 12, wherein said orifice is substantially within a connector having an inlet and an outlet, wherein said inlet comprises an internally threaded portion to engage said externally threaded portion of said body to seal said body within said bore.

* * * * *